US005632477A

United States Patent [19]

Morinaga

[11] Patent Number: 5,632,477

[45] Date of Patent: May 27, 1997

[54] SHEET LOADING DEVICE WITH SHEET POSITION REGULATOR

[75] Inventor: Kazuyuki Morinaga, Yokohama, Japan

[73] Assignee: Canon Kabushiki Kaisha, Tokyo, Japan

[21] Appl. No.: 342,016

[22] Filed: Nov. 16, 1994

[30] Foreign Application Priority Data

Nov. 24, 1993 [JP] Japan ..... 5-293174
Oct. 25, 1994 [JP] Japan ..... 6-260251

[51] Int. Cl.[6] ..... B65H 1/08

[52] U.S. Cl. ..... 271/127; 271/254; 271/160; 271/171

[58] Field of Search ..... 271/126, 127, 271/148, 160, 167, 171, 153, 154, 234, 245

[56] References Cited

U.S. PATENT DOCUMENTS

| | | | |
|---|---|---|---|
| 4,032,136 | 6/1977 | Komaba et al. | 271/171 X |
| 4,788,571 | 11/1988 | Ura et al. | 271/171 X |
| 4,874,159 | 10/1989 | Maeno et al. | 271/171 |

FOREIGN PATENT DOCUMENTS

| | | | |
|---|---|---|---|
| 84734 | 6/1980 | Japan | 271/171 |
| 72524 | 5/1982 | Japan | 271/126 |
| 111830 | 5/1987 | Japan | 271/127 |
| 271329 | 10/1989 | Japan | 271/160 |
| 62327 | 3/1990 | Japan | 271/160 |
| 300025 | 12/1990 | Japan | 271/127 |
| 153126 | 5/1992 | Japan | 271/171 |
| 69973 | 3/1993 | Japan | 271/127 |
| 105244 | 3/1993 | Japan | 271/127 |
| 310330 | 11/1993 | Japan | 271/126 |
| 92477 | 4/1994 | Japan | 271/160 |

*Primary Examiner*—Boris Milef
*Attorney, Agent, or Firm*—Fitzpatrick, Cella, Harper & Scinto

[57] ABSTRACT

A trailing end regulating device is slidably and rotatably supported by a bottom plate of a sheet cassette so as to regulate trailing ends of sheets supported on an intermediate plate in the sheet cassette. The trailing end regulating device is supported to be orthogonal to a sheet supporting surface of the intermediate plate by a guide which is mounted on the intermediate plate. Thus, the trailing end regulating device can constantly be maintained in an orthogonal state even if the intermediate plate rotates due to a change in the amount of sheets loaded, and the trailing end position of the sheets can appropriately be regulated. It is thus possible to maintain a constant amount of engagement between the sheets and separation claws used to separated the sheets from each other.

24 Claims, 15 Drawing Sheets

SHEET LOADING DEVICE WITH SHEET POSITION REGULATOR

BACKGROUND OF THE INVENTION

1. Field of the Invention

The present invention relates to a sheet loading device mounted on an image forming apparatus such as a copying machine, a printer, a facsimile or the like, and particularly to a sheet loading device for separating and feeding sheets one by one from sheet containing means containing a plurality of sheets loaded therein. Transfer paper, photosensitive paper, thermosensitive paper, electrostatic recording paper, printing paper, originals, cards, cut sheets such as envelopes and so on can be used as sheets, and the material of the sheets is not limited to paper.

2. Description of the Related Art

A conventional image forming apparatus such as a copying machine, a facsimile or the like is equipped with a sheet loading device which contains a plurality of sheets loaded in a container, and which is detachably fitted to the body of the apparatus. When the sheet loading device uses a housing-like feeding cassette, an intermediate plate that serves as sheet loading means for loading sheets is provided at the bottom of the cassette. The intermediate plate is provided so as to be vertically rotatable around an axis provided at the rear end thereof. The intermediate plate is also upwardly urged from the lower side thereof by pressure means such as a coil spring so as to press a stack of sheets loaded on the intermediate plate with a predetermined pressure against feeding means such as a feeding roller. The feeding means is driven to separate and feed the sheets one by one to the next processing area.

In the feeding operation, a claw separation method is generally widely used for preventing multiple feeding of sheets. In this method, separation claws are respectively provided at both edges of the cassette on the front end thereof in the direction of feeding of a stack of sheets. In feeding a sheet, the top sheet is separated from the other sheets by the operation of passing the top sheet over the claws while forming a small flexural loop at the leading end thereof to feed only one sheet.

FIG. 12 illustrates a principal portion of a feeding cassette which employs the claw separation method. In FIG. 12, reference numeral 51 denotes an intermediate plate for loading sheets thereon, and reference numeral 52 denotes springs for upwardly urging the intermediate plate 51 from the lower side thereof. Sheets P (cut sheets or paper) having a predetermined size are loaded on the intermediate plate 51. Reference numeral 53 denotes feeding rollers which press the upper surface of a stack of the sheets loaded on the intermediate plate 51 at a position near the leading ends of the sheets in the direction of feeding due to the lifting force of the springs 52. Reference numeral 54 denotes separation claws provided at the right and left corners on the upper surface of the feeding cassette at the leading end thereof in the direction of feeding of the sheets. The separation claws 54 are respectively mounted so as to be vertically rotatable around shafts 54*a* and gravitationally fitted to both corners at the leading end of the sheets.

When the feeding rollers 53 are rotated in the direction of arrows R, the top sheet P of a stack of the sheets is sent in the direction of the arrows X by frictional force. At this time, although the top sheet P is apt to move forward, both corners at the leading end thereof collide with the separation claws 54 to inhibit the movement of the sheet P. As a result, a flexure A is formed in the top sheet p between the separation claws 54 and the rollers 53 due to rotation of the feeding rollers 53.

If the size of the flexure A is greater than a given level, both corners of the sheet P, which are held by the separation claws 54, naturally escape from the lower sides of the separation claws 54 to the upper sides thereof by the repulsive force that tends to return the sheet P to the original form, and pass over the separation claws 54. Namely, only the top sheet P of a stack of the sheets is released from the restriction by the claws 54 by formation of the flexure A.

In such a claw separation method, the amount of engagement between the sheets P and the separation claws 54 must be kept constant for maintaining high separation performance. In other words, the amount of engagement between the sheets P and the separation claws 54 is constant during the time from loading of the sheets P to feeding of the last sheet P regardless of the number of sheets P contained in the cassette.

However, demands for increasing the sheet capacity have recently increased because of an increase in the typical volume of communication conducted, and thus attempts have vigorously been made to increase the capacity of the cassette. The cassette case thus has a shape increased in depth. In such a feeding cassette, the rotational axis of the intermediate plate is provided at substantially the center of the depth of the cassette in consideration of the condition that the forward and backward movement of the intermediate plate caused by rotation of the front end thereof is suppressed as much as possible. However, the range of rotation of the intermediate plate becomes wider because of the large depth of the cassette, and thus it is difficult to keep the amount of engagement between the sheets and the separation claws constant.

FIGS. 13(*a*) to (*c*) illustrate full loading, medium loading and small loading states, respectively, of the sheets P in the cassette where the amount of engagement between the sheets P and the separation claws 54 is kept constant. Reference characters Pu(a), Pu(b) and Pu(c) indicate the trailing ends of the sheets in the cassette in the full loading, medium loading and small loading states, respectively. In a small-capacity cassette, a method is generally employed in which trailing end regulating means such as a trailing end regulating plate for regulating the position of the trailing ends of the sheets is fixed to the cassette case. When this method is applied to a large-capacity cassette, the trailing end regulating plate must be fixed at a sheet trailing end position b of the sheets in the full loading state, and a gap a thus occurs between the position of the sheet trailing ends of the sheets in the middle loading and small loading states, as shown in FIGS. 13(*b*) and (*c*), respectively. In addition, since the range of rotation of the intermediate plate 51 becomes wider, the inclination of the intermediate plate 51 in the small loading state of the sheets is increased, and the sheets P slip downward to the side of the trailing ends in an amount of the gap a. In a cassette having a capacity of about 500 sheets, the maximum gap a is about 5 to 6 mm. Thus, the amount of engagement between the sheets P and the separation claws 54 at the leading ends of the sheets cannot be uniformly maintained, thereby causing poor separation and thus the possibility of deterioration in separation performance.

The techniques proposed for solving the above problems are as follows:

(1) A technique in which a trailing end regulating plate 56 is rotatably pivoted to the bottom of a cassette case 55 containing the intermediate plate 51 so as to pass through a cut hole 51*a* formed in the intermediate plate 51, as shown in FIG. 14(*a*). When the intermediate plate 51 rotates around the rotational axis 51*b* in accordance with the amount of the sheets loaded, one widthwise side of the cut hole 51*a* is accompanied by the trailing end regulating plate 56, thereby preventing deviation from occurring between the respective sheets due to a change in the amount of sheets P loaded.

(2) Another technique in which a trailing end regulating plate 57 is provided so as to be slidable in the lengthwise direction of the sheets P contained in the cassette 58, as shown in FIG. 15(*a*). When an intermediate plate 59 is upwardly rotated around a rotational axis 59*a* by pressure means (not shown), the intermediate plate 59 is connected to the trailing end regulating plate 57 by a connecting member 60 to slide the trailing end regulating plate 57 in linkage with the rotation of the intermediate plate 59, thereby preventing the gap produced at the trailing ends of the sheets.

However, there have recently been demands for increasing the capacity of the cassette and making the cassette universally suitable for different sheet sizes. It is thus necessary that the trailing end regulating plate satisfies the same function as that in a regular state regardless of the position of the trailing end regulating plate.

In technique (1), although the angle of the trailing end regulating plate 56 with respect to the intermediate plate 51 is determined by one side of the cut hole 51*a* for guiding the trailing end regulating plate 56, since the lower end of the trailing end regulating plate 56 is pivoted to the cassette case 55, the rotational axis 51*b* must be set at the lowermost position, i.e., the bottom, of the cassette case 55, to ensure an appropriate rotation range of the intermediate plate 51. However, as described above, in a large-capacity cassette, in order to prevent, as much as possible, forward and backward displacement of the front end of the intermediate plate 51, it is effective for maintaining the separation performance to set the rotational axis 51*b* of the intermediate plate 51 at substantially the vertical center of the cassette case 55. When the rotational fulcrum 51*b* is then set at substantially the vertical center of the cassette case 55, as shown in FIG. 14(*b*), the trailing end regulating plate 56 is pushed forward by one lengthwise side of the cut hole 51*a* and is therefore caused to be inclined by upward rotation of the intermediate plate 51. Thus, the sheets P are excessively pushed forward by the upper portion of the trailing end regulating plate 56, and the sheets P collide with the separation claws and interfere with the free vertical movement of the separation claws, thereby causing the possibility of poor feeding. In addition, the upward movement of the sheets P is interrupted by the collision with the front side of the cassette case 55, and the top sheet P idles without contacting the feeding rollers, thereby causing the possibility of no feeding.

Although conventional technique (2) is effective for the case where the trailing end regulating plate 57 is near the rotational axis 59*a* of the intermediate plate 59, when the trailing end regulating plate 57 is in front of the rotational axis 59*a*, e.g., when the sheets have a short size such as A5 size or the like, the trailing end regulating plate 57 is excessively moved forward from the sheet trailing ends. Namely, the trailing ends of the sheets are excessively pushed by the trailing end regulating plate 57, thereby causing the possibility of poor feeding or no feeding, as in conventional technique (1).

In order to solve the above problems, a degree of play may be permitted in the operation of the trailing end regulating plate. However, this brings about a degree of variation of the amount of engagement between the sheets and the separation claws, and the initial purpose of the trailing end regulating plate cannot be thus achieved.

SUMMARY OF THE INVENTION

An object of the present invention is to provide a sheet loading device which can appropriately regulate the trailing ends of sheets regardless of changes in the amount of the sheets loaded so as to maintain a constant amount of engagement between the sheets and separation claws.

In order to achieve the above-noted object, one aspect of the present invention provides a sheet loading device which is mounted on the body of an apparatus so as to contain sheets to be fed by sheet feeding means. The loading device comprises sheet containing means for containing a plurality of sheets, sheet supporting means, rotatably provided on the sheet containing means, for supporting the sheets, a separation claw for separating, one by one, the sheets supported by the sheet supporting means when the sheets are fed by the sheet feeding means, trailing end regulating means for regulating the trailing end position of the sheets supported on the sheet supporting means, and guide means, provided at a predetermined position of the sheet supporting means, for supporting and maintaining the trailing end regulating means at a predetermined angle with respect to a supporting surface of the sheet supporting means for supporting the sheets.

Another object of the present invention is to provide a sheet loading device which can appropriately regulate the trailing ends of sheets regardless of changes in the amount of sheets loaded, and which can prevent the upper end of the trailing end regulating means from projecting upward from the sheet loading device regardless of the rotational position of the sheet supporting means, thereby permitting a decrease in the size of the device.

In order to achieve the above-mentioned object, another aspect of the present invention provides a sheet loading device which is mounted on the body of an apparatus so as to contain sheets to be fed by sheet feeding means. The sheet loading device comprises sheet containing means for containing a plurality of sheets, sheet supporting means, rotatably provided on the sheet containing means, for supporting the sheets, a separation claw for separating, one by one, the sheets supported by the sheet supporting means when the sheets are fed by the sheet feeding means, trailing end regulating means, swingably mounted on the bottom of the sheet containing means, for regulating the trailing end position of the sheets supported on the sheet maintaining means, and guide means for maintaining the trailing end regulating means at a constant angle with respect to a supporting surface of the sheet supporting means for supporting the sheets.

Yet another aspect of the present invention provides an image forming apparatus including a sheet loading device comprising sheet containing means for containing a plurality of sheets, sheet supporting means, rotatably provided on the sheet containing means, for supporting sheets, a separation claw for separating, one by one, the sheets supported by the sheet supporting means when the sheets are fed by the sheet feeding means, trailing end regulating means for regulating the trailing end position of the sheets supported on the sheet supporting means, and guide means, provided at a predetermined position of the sheet supporting means, for maintaining the trailing end regulating means at a predetermined angle with respect to a supporting surface of the sheet supporting means for supporting the sheets. The image forming apparatus also includes sheet feeding means for feeding the sheets contained in the sheet loading device and image forming means for forming an image on a sheet fed by the sheet feeding means.

Still another aspect of the present invention provides an image forming apparatus including a sheet loading device comprising sheet containing means for containing a plurality of sheets, sheet supporting means, rotatably provided on the sheet containing means, for supporting sheets, a separation claw for separating, one by one, the sheets supported by the sheet supporting means when the sheets are fed by sheet feeding means, trailing end regulating means, swingably mounted on the bottom of the sheet containing means, for regulating the trailing end position of the sheets supported on the sheet supporting means, and guide means for maintaining the trailing end regulating means at a predetermined angle with respect to a supporting surface of the sheet supporting means for supporting the sheets. The image forming apparatus also includes sheet feeding means for feeding the sheets contained in the sheet loading device and image forming means for forming an image on a sheet fed by the sheet feeding means.

DETAILED DESCRIPTION THE PREFERRED EMBODIMENT

Figure 1:
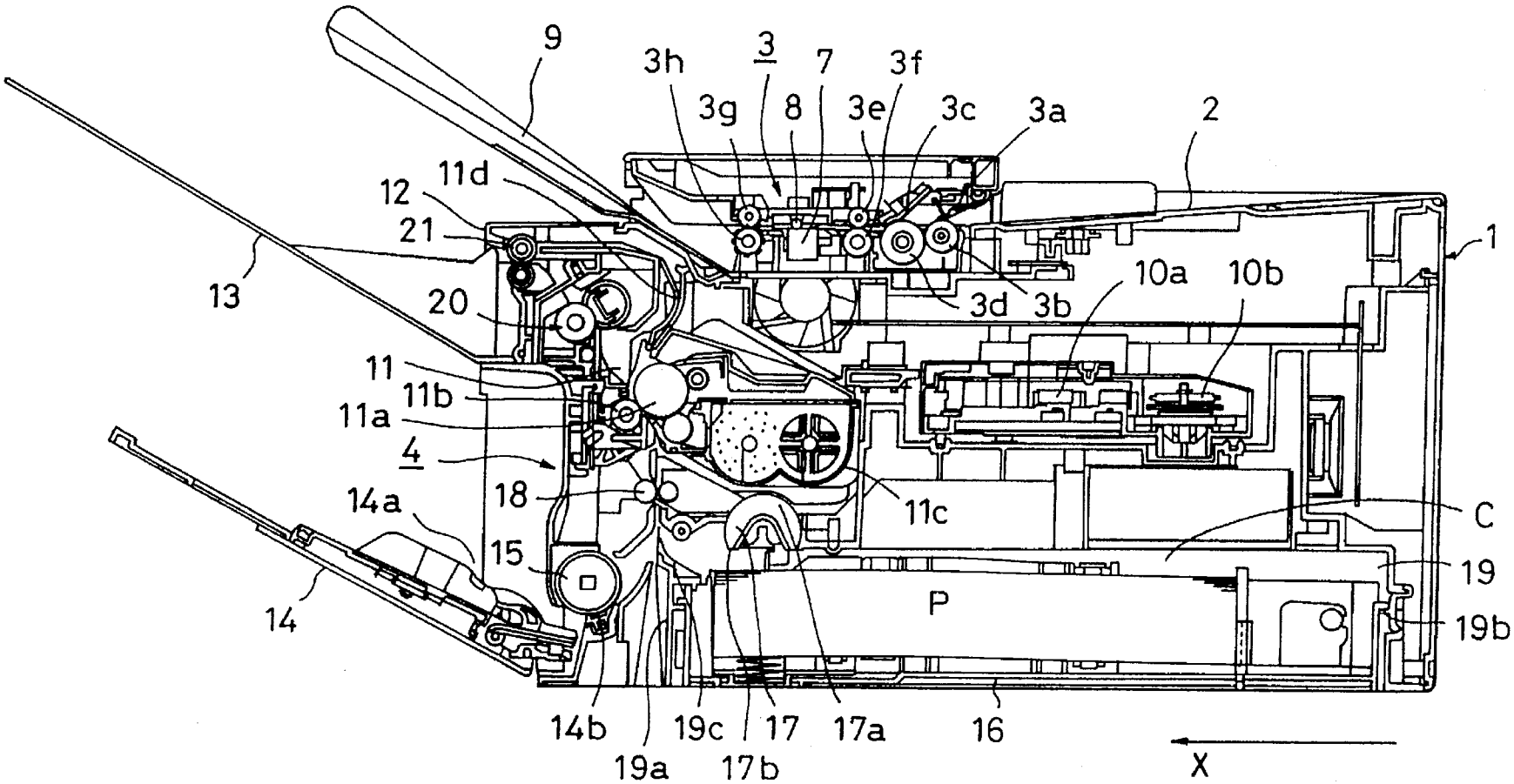
FIG. 1 is a sectional view illustrating the schematic construction of a facsimile apparatus.
Figure 2:
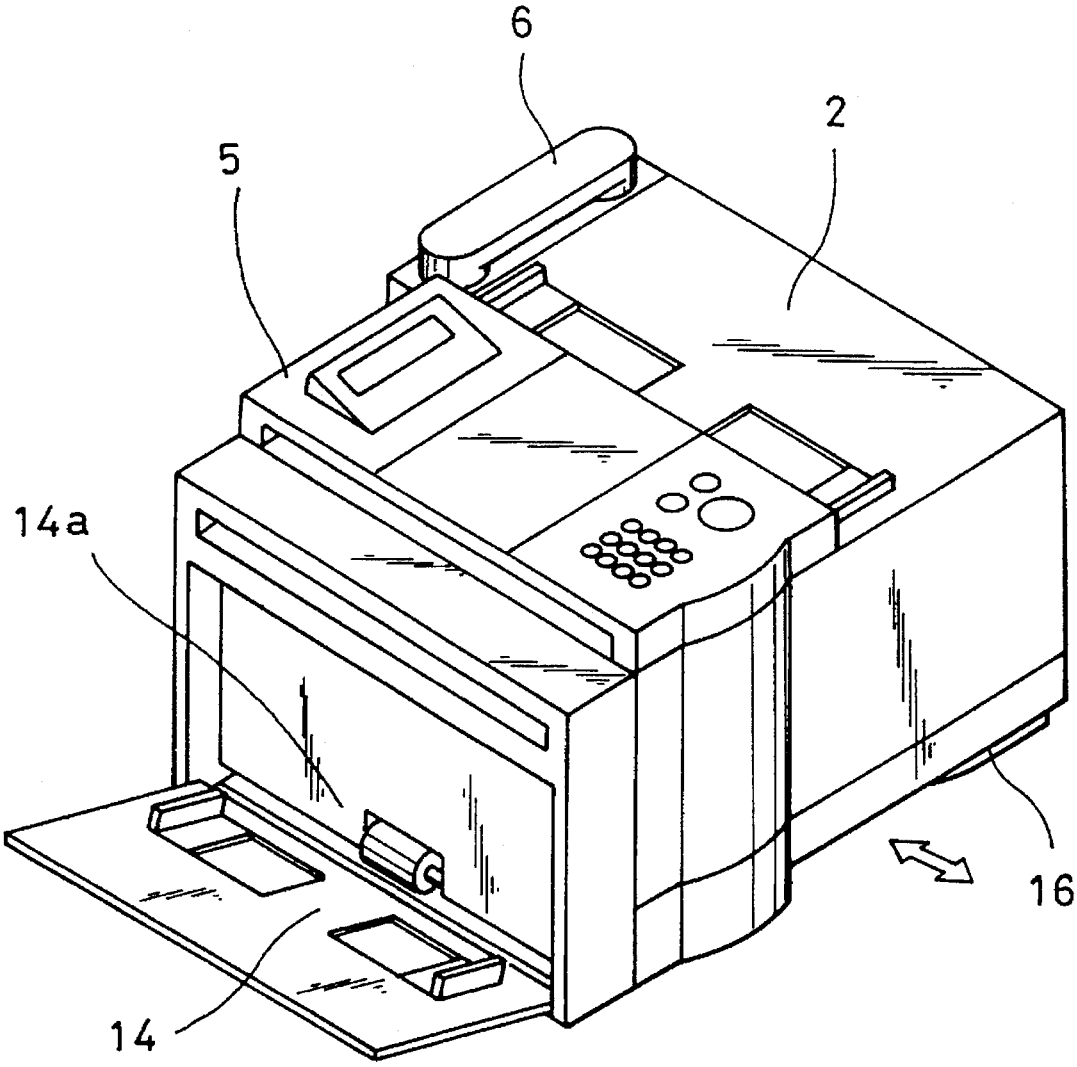
FIG. 2 is a perspective view illustrating the outer construction of the facsimile apparatus.
Figure 3:
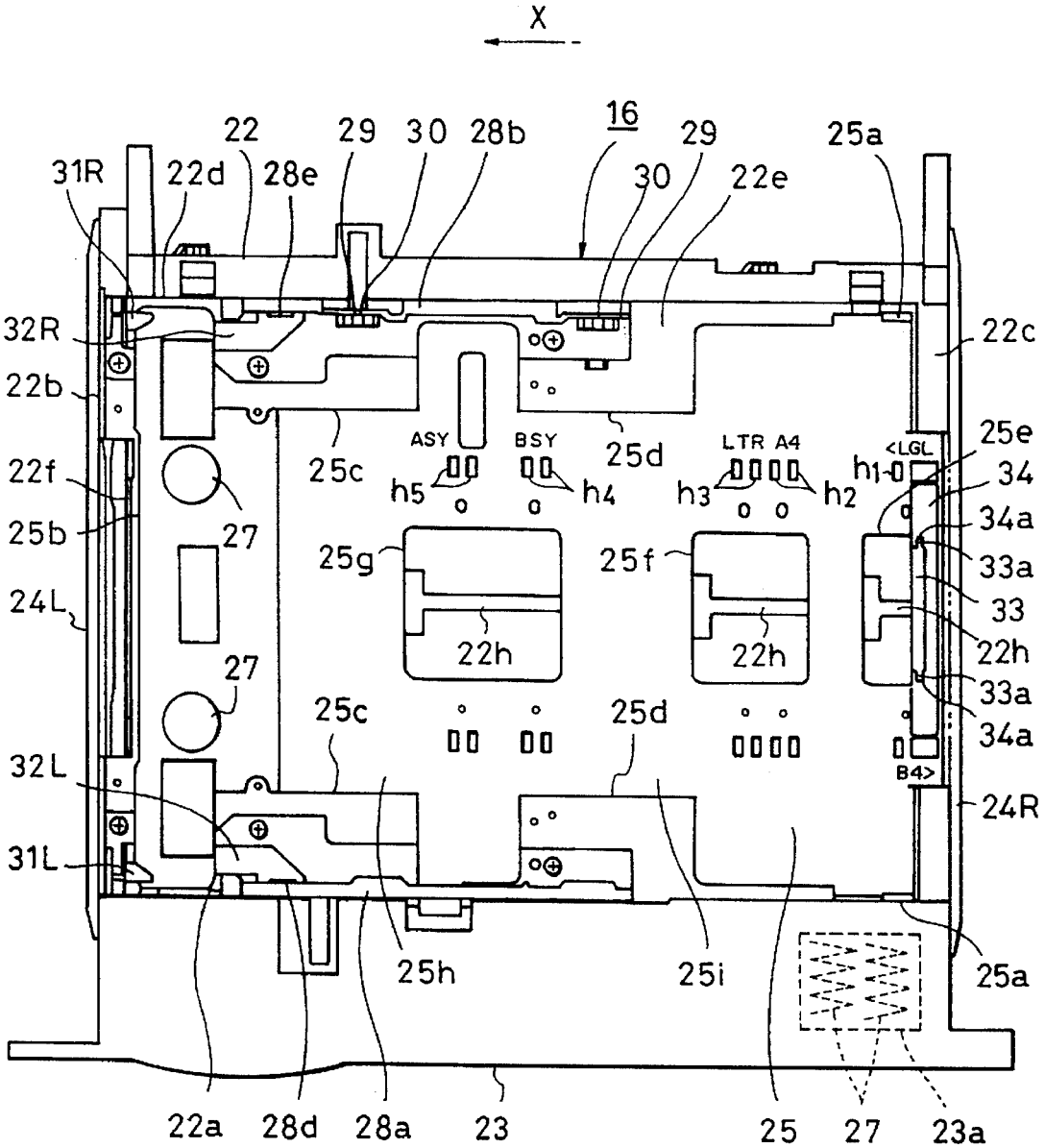
FIG. 3 is a plan view illustrating a feeding cassette.
Figure 4:
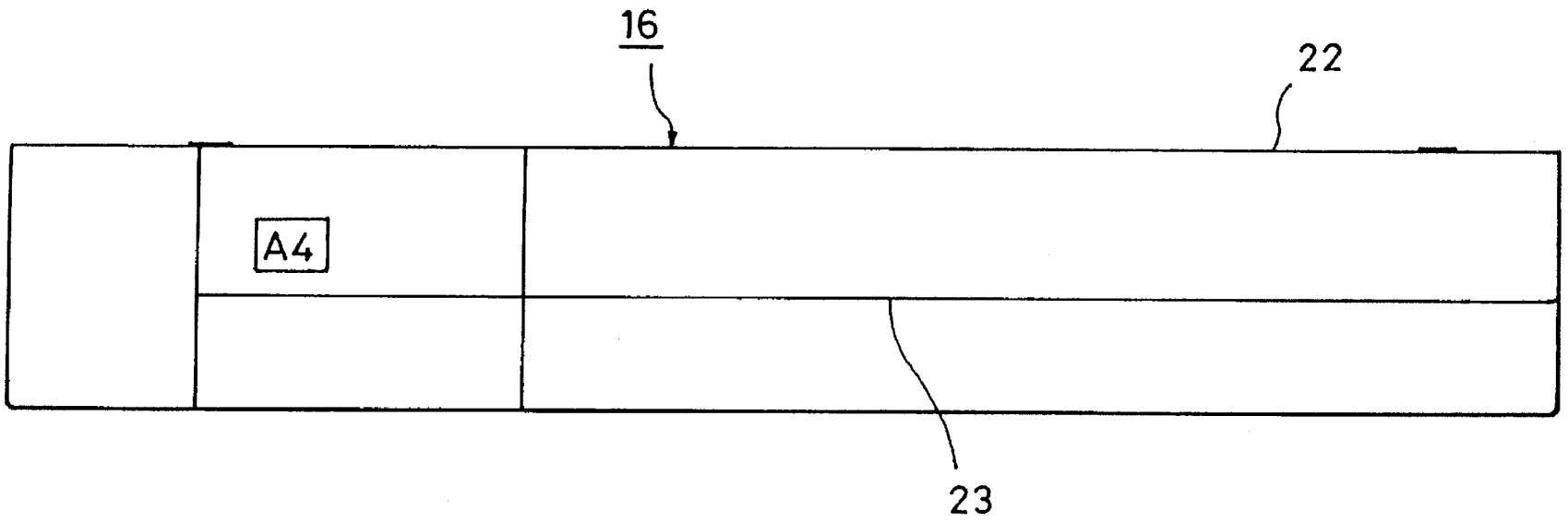
FIG. 4 is a front view illustrating the feeding cassette.
Figure 5:
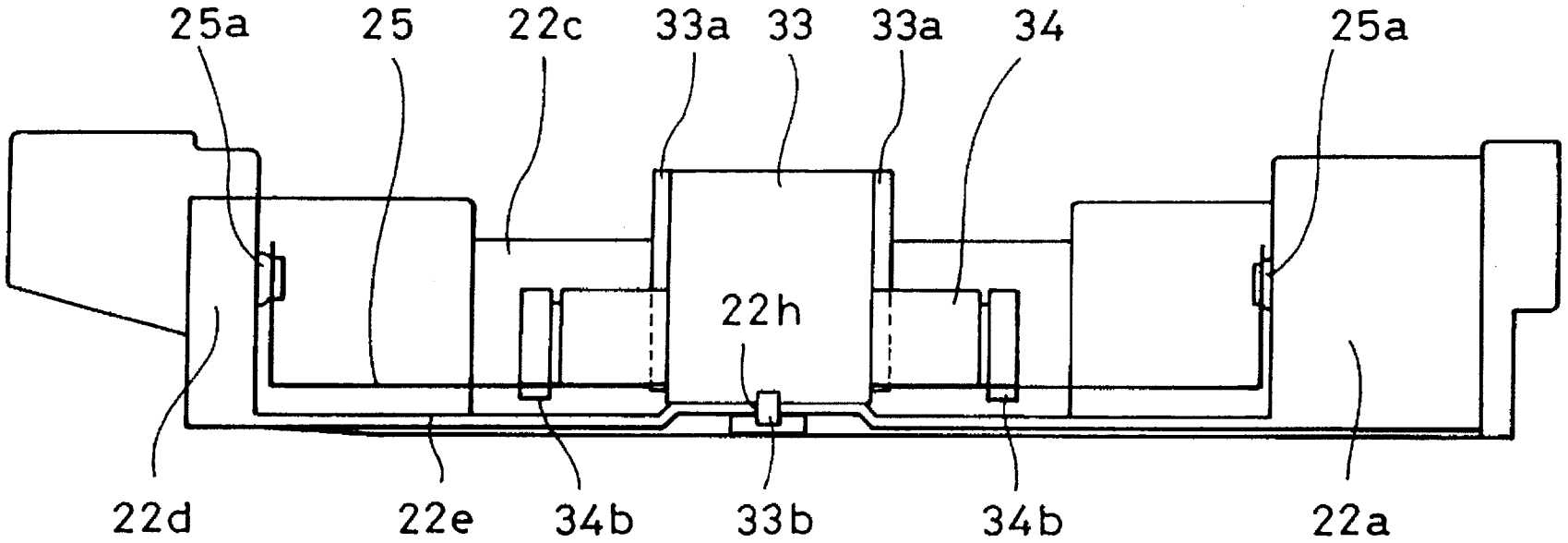
FIG. 5 is a longitudinal sectional view illustrating the feeding cassette.
Figure 6:
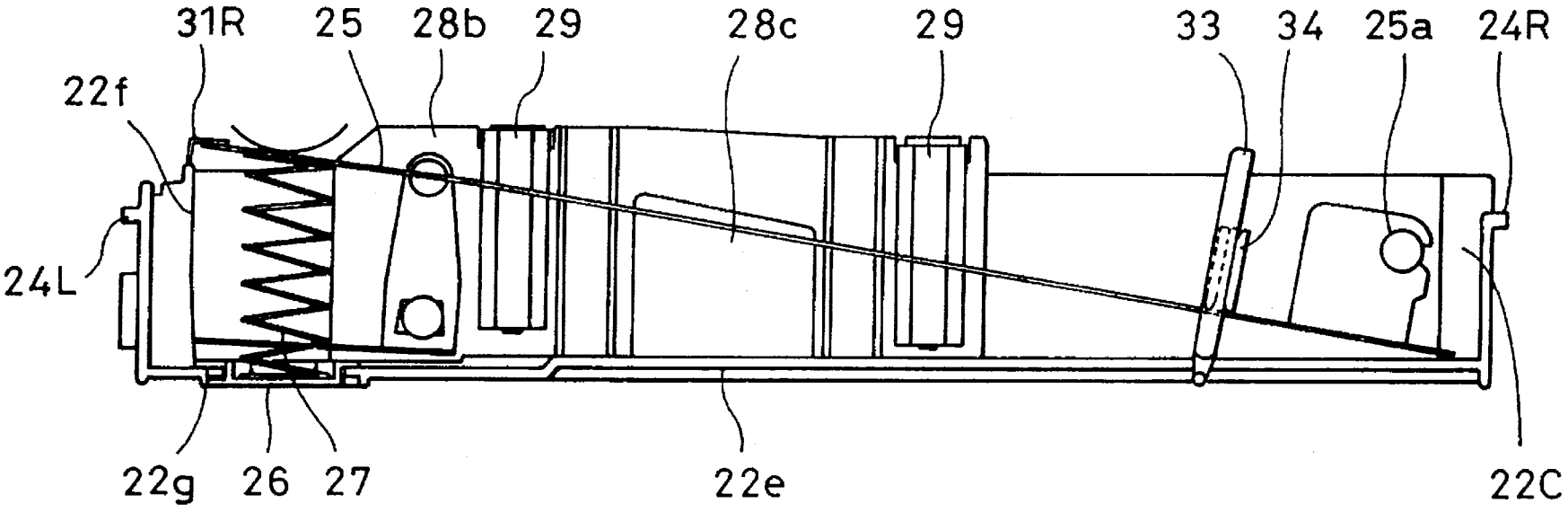
FIG. 6 is a lateral sectional view illustrating the feeding cassette.
Figure 7:
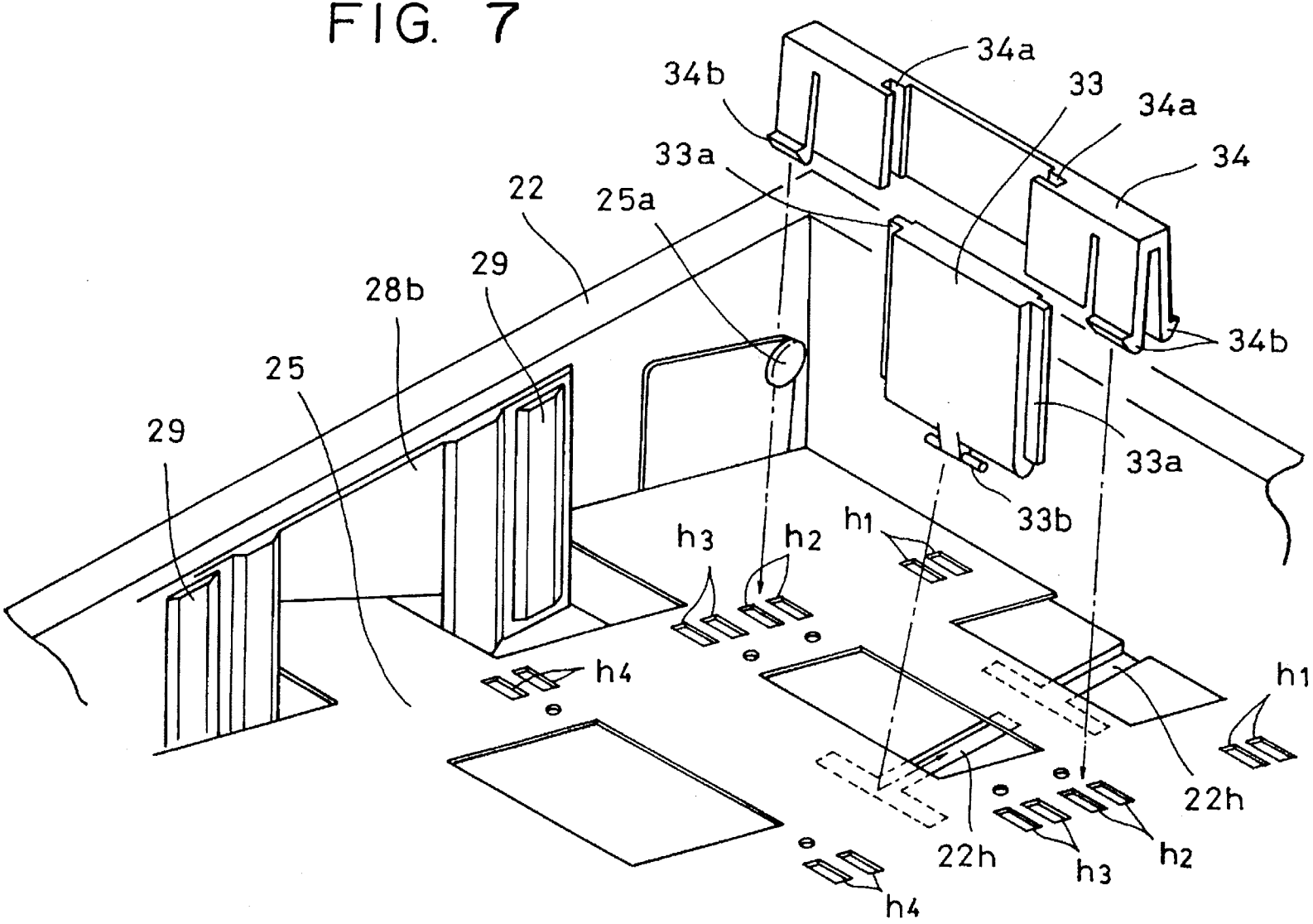
FIG. 7 is an exploded perspective view illustrating a state before a trailing end regulating plate is mounted.
Figure 8:
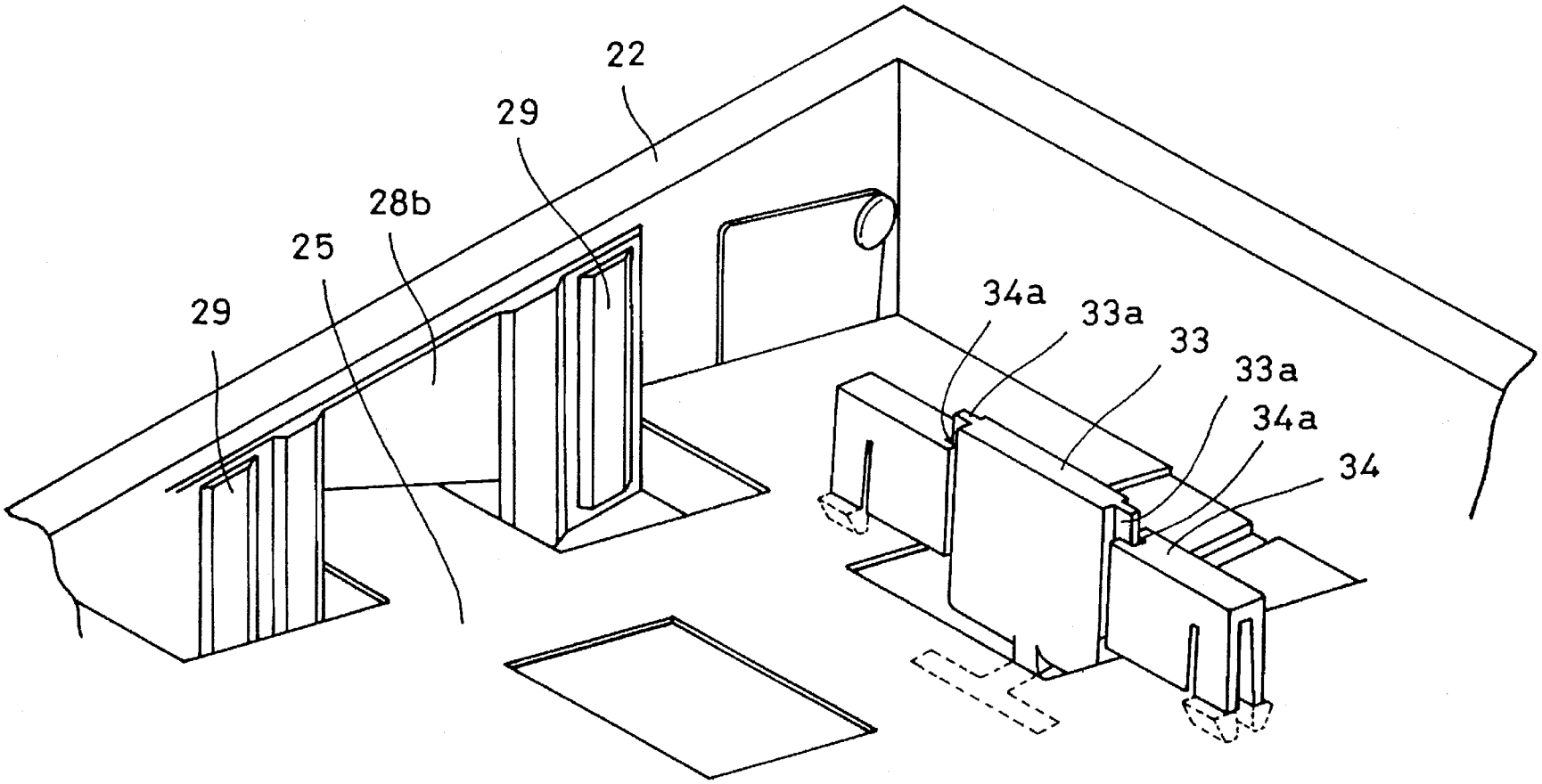
FIG. 8 is a perspective view illustrating a state wherein a trailing end regulating plate is mounted.
Figure 9A:
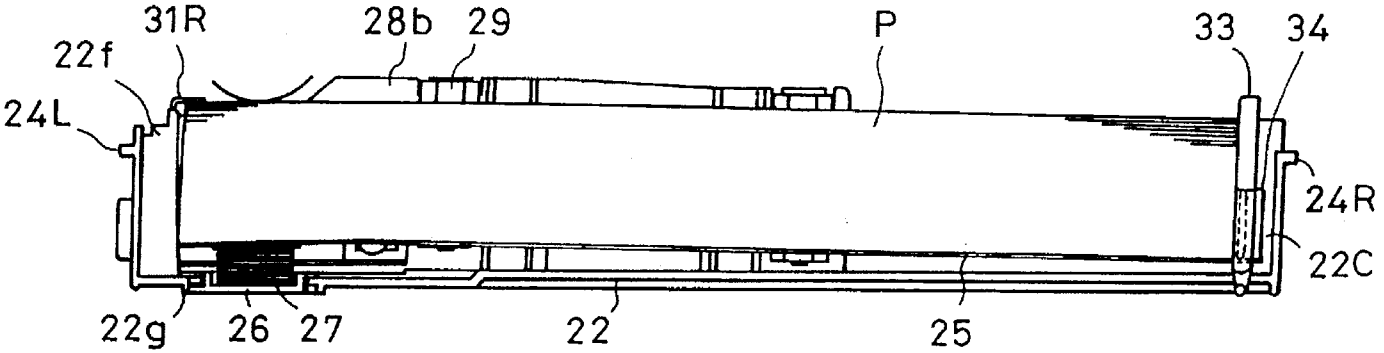
FIGS. 9(*a*) to 9(*c*) are drawings illustrating the movement of the trailing end regulating plate.
Figure 9B:
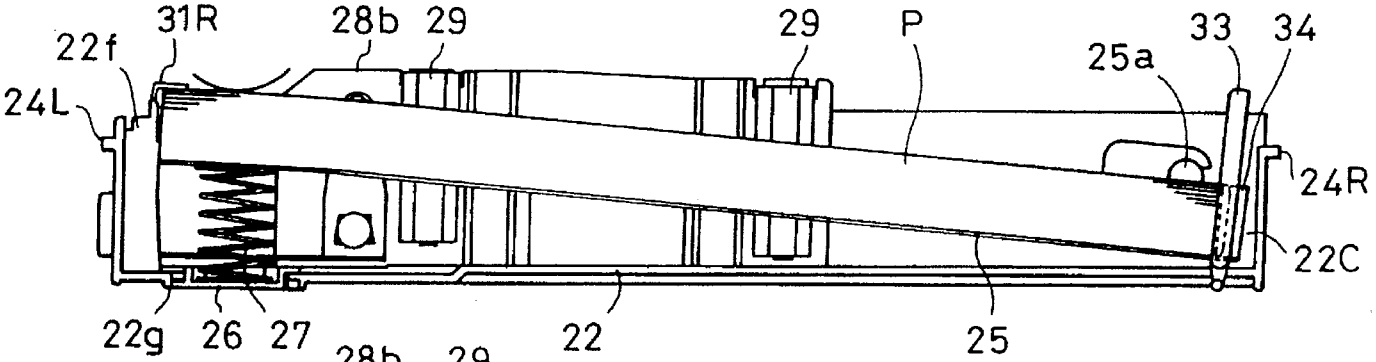
Figure 9C:
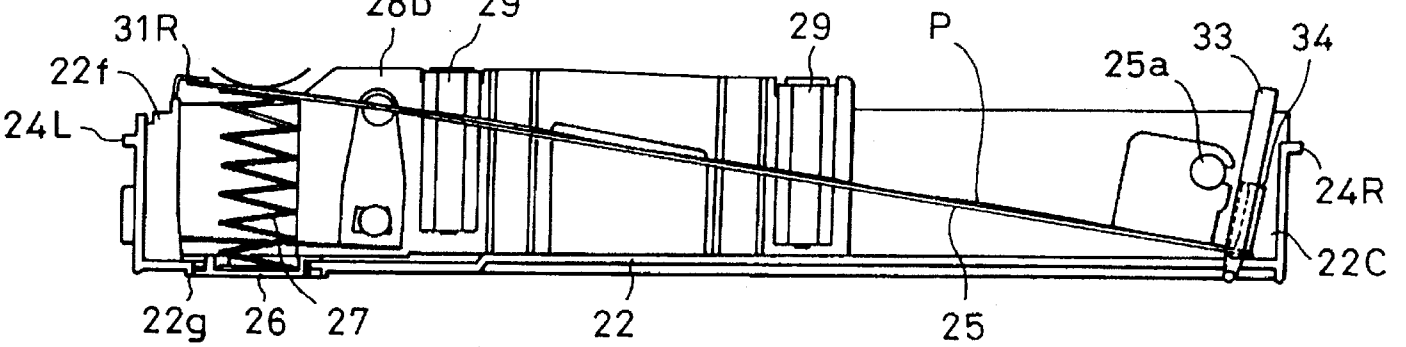

A sheet loading device in accordance with an embodiment of the present invention is described below with reference to the drawings. This embodiment relates to a sheet loading device which is mounted on a facsimile apparatus used as an image forming apparatus. FIG. 1 is a sectional view illustrating the schematic construction of a facsimile apparatus, FIG. 2 is a perspective view illustrating the outer construction of the facsimile apparatus, FIG. 3 is a plan view of a feeding cassette, FIG. 4 is a front view of the feeding cassette, FIG. 5 is a longitudinal sectional view of the feeding cassette, FIG. 6 is a lateral sectional view of the feeding cassette, FIG. 7 is a perspective view illustrating a state before a trailing end regulating plate is mounted on an intermediate plate, FIG. 8 is a perspective view illustrating a state wherein the trailing end regulating plate is mounted on the intermediate plate, and FIG. 9 is a drawing illustrating the movement of the trailing end regulating plate.

(Construction of Facsimile Apparatus)

The schematic construction of the facsimile apparatus is described with reference to FIGS. 1 and 2. In FIG. 1, reference numeral 1 denotes the body of the facsimile apparatus having an upper cover which serves as an original loading base 2 on which a plurality of originals S can be loaded. Reference numeral 3 denotes an optical reading system for reading an image on an original S sent from the original loading base 2. A recording system 4 comprising a laser beam printer is disposed below the optical reading system 3. As illustrated in FIG. 2, a console panel 5, a telephone 6 and so on are provided on the upper surface of the apparatus body 1.

The construction of the optical reading system 3 is described below. A plurality of originals which are loaded upside down on the original loading base 2 are successively fed from the bottom side by a pre-conveyance pressing piece 3*a* and a pre-conveyance roller 3*b* to form a wedge-like leading end, and then separated and conveyed, one by one, by a separation pressing piece 3*c* and a separating roller 3*d*. Each of the originals S is conveyed to a contact sensor 7 disposed at a reading position by a main conveyance roller 3*f* and a feeding roller 3*e* in pressure contact with the main conveyance roller 3*f*. An image of the original S is read in close contact with the contact sensor 7, which is achieved by pressing means 8. After the image of the original S is read, the original is conveyed by an original delivery roller 3*h* and a delivery roller 3*g* in pressure contact with the original delivery roller 3*h* to be delivered to an original delivery tray 9.

The construction of the recording system 4 is described. A modulating signal is generated by a laser beam oscillator 10*a* on the basis of an image signal of the contact sensor 7, and a modulated beam is applied as a scanning beam to a photosensitive drum 11*a* of an image forming section 11 by a polygon mirror 10*b* to form a latent image. The latent image is developed by development means, and then the developed image is transferred when the recording sheet P supplied from a feeding section, which will be described below, passes between the photosensitive drum 11*a* and a transfer roller 11*b*. The photosensitive drum 11*a* and image forming means provided around the drum 11*a* and including development means are mounted in a cartridge 11*c*. The cartridge 11*c* is formed so that it can be drawn out from the apparatus body 1 by opening a closing cover 12 and exchanged for another cartridge. The closing cover 12 is formed in linkage with a drum sensitization preventing shutter 11*d* which is closed when the closing cover 12 is open, and is open when the closing cover 12 is closed.

Reference numeral 20 denotes a fixing device for fixing the image transferred onto the recording sheet P by the image forming section 11, and reference numeral 21 denotes a pair of delivery rollers for delivering the recording sheet P to a recording sheet delivery tray 13 after fixing of the image.

The closing cover 12 is formed on the left side of the apparatus body 1, the recording sheet delivery tray 13 and a hand insertion type recording sheet loading tray 14 being provided on the closing cover 12. The recording sheet loading tray 14 is openably provided on the closing cover 12 and can be moved between an open position and a closed position. When the recording sheet loading tray 14 is pushed down to the open position, as shown in FIG. 1, a hand insertion port 14*a* is open so that the recording sheets P can be fed. In other words, when the sheet loading tray 14 on which the recording sheets P are loaded is inserted into the hand insertion port 14*a*, the conveyance roller 15 is driven to separate and feed the sheets P one by one between the conveyance roller 15 and a separation pad 14*b* in pressure contact with the conveyance roller 15, and then convey the sheets to the recording system 4.

The feeding section is described below. A feeding cassette 16 containing the recording sheets P loaded therein is mounted on the bottom of the apparatus body 1 so that it can be drawn out from the front side of the apparatus body 1 (front loading). The recording sheets P are separated and fed, one by one, by the feeding roller 17 disposed above the cassette 16. The separated and fed recording sheet P is conveyed to a pair of register rollers 18 which are stopped for correcting the oblique movement of the sheets, and then conveyed synchronously with the developed image formed on the photosensitive drum 11*a*. The developed image is then transferred during passage between the photosensitive drum 11*a* and the transfer roller 11*b*.

An opening 19 is formed in a lower portion of the front side of the apparatus body 1, i.e., in a portion for mounting the feeding cassette 16. In the opening 19, a space C for containing the cassette is formed by the right and left walls and the back wall. The cassette 16 can be mounted and removed by moving the flange formed on the outer wall thereof along rails 19*a* and 19*b* formed on the right and left walls. This embodiment employs a front loading method in which the feeding cassette 16 can be mounted from the front side of the apparatus. The direction of feeding of the recording sheets (the direction of arrow X shown in FIG. 1) is thus at right angles with the direction in which the cassette is mounted and removed.

Feeding roller 17 is provided on the upper left side of the space C, and a sheet guide 19*c* is formed on the left wall so as to guide the recording sheet P fed by the feeding roller 17 from the feeding cassette 16 to the pair of register rollers 18. When the feeding cassette 16 is in a no-loading state or feeding standby state, the feeding roller 17 is in a standby state wherein the circular surface 17*a* and a notch surface 17*b* are on the upper and lower sides, respectively, so that feeding roller 17 does not project into the space C. In this way, care is taken not to interfere with installation and removal of the feeding cassette 16.

(Sheet Loading Means)

The construction of the feeding cassette 16 is described in detail below with reference to FIGS. 3 to 9. In FIG. 3, the feeding cassette 16 is equipped with a housing-like body case 22 having an open upper side. The body case 22 has a front wall 22*a*, left and right side walls 22*b* and 22*c*, a back wall 22*d*, a bottom plate 22*e*, a sheet leading end butt wall 22*f*, etc. The left and right side walls 22*b* and 22*c* have elongated flanges 24L and 24R, respectively, which are formed to project outwardly along the upper sides thereof. The feeding cassette 16 can be mounted in the opening 19 by engaging the elongated flanges 24L and 24R, and the rail portions 19*a* and 19*b*, respectively, which are respectively formed on the left and right walls of the opening 19. The body case 22, a handle 23 and the elongated flanges 24L and 24R are integrally formed by molding a resin.

Reference numeral 25 denotes an intermediate plate provided in the body case 22 so that the front side 25*b* is vertically rotatable around a an axis 25*c* set on the trailing end side in the direction of feeding of the sheets. The recording sheets P are loaded on the intermediate plate 25 and contained in the body case 22. Reference numeral 26 (FIG. 6) denotes a cassette bottom cover which is detachably fitted into a hole 22*g* (FIG. 6) provided in the bottom plate 22*e* of the body case 22, as shown in FIG. 6. Reference numeral 27 denotes a pressure spring interposed between the intermediate plate 25 and the bottom cover 26. When the cassette bottom cover 26 is fitted into the hole 22*g*, the pressure spring 27 is supported on the cassette bottom cover 26, and upwardly urges the intermediate plate 25 so that the sheets P loaded on the intermediate plate 25 contact the feeding roller 17 under a predetermined pressure.

The intermediate plate 25 has notches 25*c* and 25*d* which are formed at two positions symmetrical with respect to the direction of feeding of the sheets (the direction of arrow X), as shown in FIG. 3. The intermediate plate 25 also has a notch 25*e* and cut holes 25*f* and 25*g*, which are formed at substantially the center thereof. The narrow portions 25*h* and 25*i* of the intermediate plate 25, which are formed by providing the notches 25*c* and 25*d*, have a width smaller than the width of a recording sheet of the minimum size. The wide portions of the intermediate plate 25 have a width greater than the width of a recording sheet of the maximum size. The body case 25 also has the side regulating plates 28*a* and 28*b* which are provided on the bottom plate 22*e* so as to regulate the widthwise position of the recording sheets P loaded on the intermediate plate 25. The side regulating plates 28*a* and 28*b* are movable in the widthwise direction of the sheets P with respect to the direction of feeding of the sheets P. When the side regulating plates 28*a* and 28*b* move in the widthwise direction, the plates enter the notches 25*c* and 25*d* to regulate the both sides of the recording sheets P of small size by holding the sheets P therebetween.

The notches 25*c* and 25*d* of the intermediate plate 25 are formed so as not to be positioned at the trailing end of the recording sheets P used. In this embodiment, the notches 25*c* are formed at positions in front of the trailing end of the recording sheets P of the minimum A5 size in the direction of feeding, and the notches 25*d* are formed at positions behind the trailing end of the recording sheets P of B5 size and in front of the trailing end of the recording sheets P of letter size in the direction of feeding. The intermediate plate 25 can support the trailing ends of the recording sheets P of all sizes and prevent the trailing ends of the recording sheets from hanging down and curling or wrinkling.

Each of the side regulating plates 28*a* and 28*b* has a positioning projection (not shown) which is provided on the lower side thereof and inserted into the bottom plate 22*e* of the body case 22 to position the side regulating plates 28*a* and 28*b*. The side regulating plates 28*a* and 28*b* are also formed in such a manner that the widthwise positions can be changed with changes in the size of the recording sheets P for regulating the sides of the recording sheets P having different sizes.

Reference numeral 29 denotes side pressers which are provided on the right side regulating plate 28*b* opposite to the side of the recording sheets P. Reference numeral 30 denotes an urging spring for urging the side pressers 29 to appropriately press the sides of the recording sheets P. In this embodiment, the side pressers 29 are provided at front and rear positions of the side regulating plate 28*b* in the direction of feeding of the sheets P. Both front and rear side pressers 29 operate for long recording sheets P of B4 or A4 size, and only the front side presser 29 operates for short recording sheets P of A5 or B5 size. As illustrated in FIG. 6, each of the side regulating plates 28*a* and 28*b* has a cavity 28*c* which is formed substantially at the center thereof so as not to interfere with the wide portions of the intermediate plate 25 when regulating the sides of the recording sheets P of a small size.

Reference numerals 31L and 31R denote separation claws which are formed at the tips of levers 32L and 32R, respectively, mounted on the left and right side regulating plates 28*a* and 28*b* so as to be vertically rotatable around support shafts 28*d* and 28*e*. The left and right separation claws 31L and 31R are positioned at the left and right corners of the top recording sheet on the leading end side thereof when the sides of the recording sheets P loaded on the intermediate plate 25 in the body case 22 are regulated by the side regulating plates 28*a* and 28*b*.

In FIGS. 5 to 8, reference numeral 33 denotes a trailing end regulating plate for regulating the trailing end position of the recording sheets P loaded on the intermediate plate 25. The trailing end regulating plate 33 has rib-formed projections 33*a* which are formed on the right and left sides thereof so as to project outwardly from the sides. Reference numeral 34 denotes a trailing end regulating plate guide which loosely engages the projections 33*a* of the trailing end regulating plate 33 through grooves 34*a* (FIG. 7) to always guide the trailing end regulating plate 33 to an orthogonal state with respect to the intermediate plate 25. As illustrated in FIGS. 7 and 8, when the legs 34*b* thereof are fitted into the holes $h_1$ to $h_5$ formed at predetermined positions of the intermediate plate 25, the trailing end regulating plate guide 34 is orthogonally fixed so as to rotate integrally with the intermediate plate 25. Alternatively, grooves may be formed on the left and right sides of the trailing end regulating plate 33, and projections which engage the grooves may be formed on the trailing end regulating plate guide 34.

The trailing end regulating plate 33 is arranged to pass through any one of the notch 25*e* and the cut holes 25*f* and 25*g* of the intermediate plate 25 in accordance with the size of the recording sheets P used. The trailing end regulating plate 33 has a guide piece 33*b* which is formed on the lower portion hereof. The guide piece 33*b* is fitted into a slit 22*h* provided at the center of the bottom plate 22*e* in the direction of feeding of the sheets P so as to be movable back and forth in the direction of feeding. FIGS. 7 and 8 respectively show the states before and after the trailing end regulating plate 33 is combined with the trailing end regulating plate guide 34.

The above construction permits the trailing end regulating plate 33 guided by the trailing end regulating plate guide orthogonally fixed to the intermediate plate 25 to be maintained in a state orthogonal to the intermediate plate 25 even if the intermediate plate 25 rotates in accordance with changes in the amount of the recording sheets loaded.

Description will now be made of the operation of feeding the recording sheets P in the feeding cassette 16 constructed as described above. In FIG. 1, when a mode for feeding the recording sheets P is selected by the console portion of the apparatus body 1 in the state wherein the feeding cassette 16 is completely mounted on the apparatus body 1, and when an image formation start signal is input to a control circuit (not shown), a one-rotation spring clutch (not shown) for transmitting drive to the feeding roller 17 is turned on, and the feeding roller 17 makes one clockwise rotation. At this time, the circular surface 17*a* of the feeding roller 17 contacts the top of the stack of recording sheets P loaded on the intermediate plate 25, and thus the feeding force acts to separate only the top sheet P by the separation claws 31L and 31R and feed the sheet toward the front wall 22*a* of the body case 22.

The thus-separated and fed recording sheet P is guided by the sheet guide 19*c* until the leading end thereof collides with the nip portion between a pair of the register rollers 18 which are temporarily stopped for correcting oblique movement of the recording sheet P. When an electromagnetic clutch (not shown) is then electrically charged with a predetermined timing, a drive force is transmitted to the pair of register rollers 18 to convey the recording sheet P to the image forming section 11. As described above, each of the recording sheets P loaded and contained in the feeding cassette 16 is fed to the image forming section 11 at one rotation of the feeding roller 17. In the image forming section 11, images are successively formed by a known electrophotographic process.

Figures 13A, 13B, 13C:
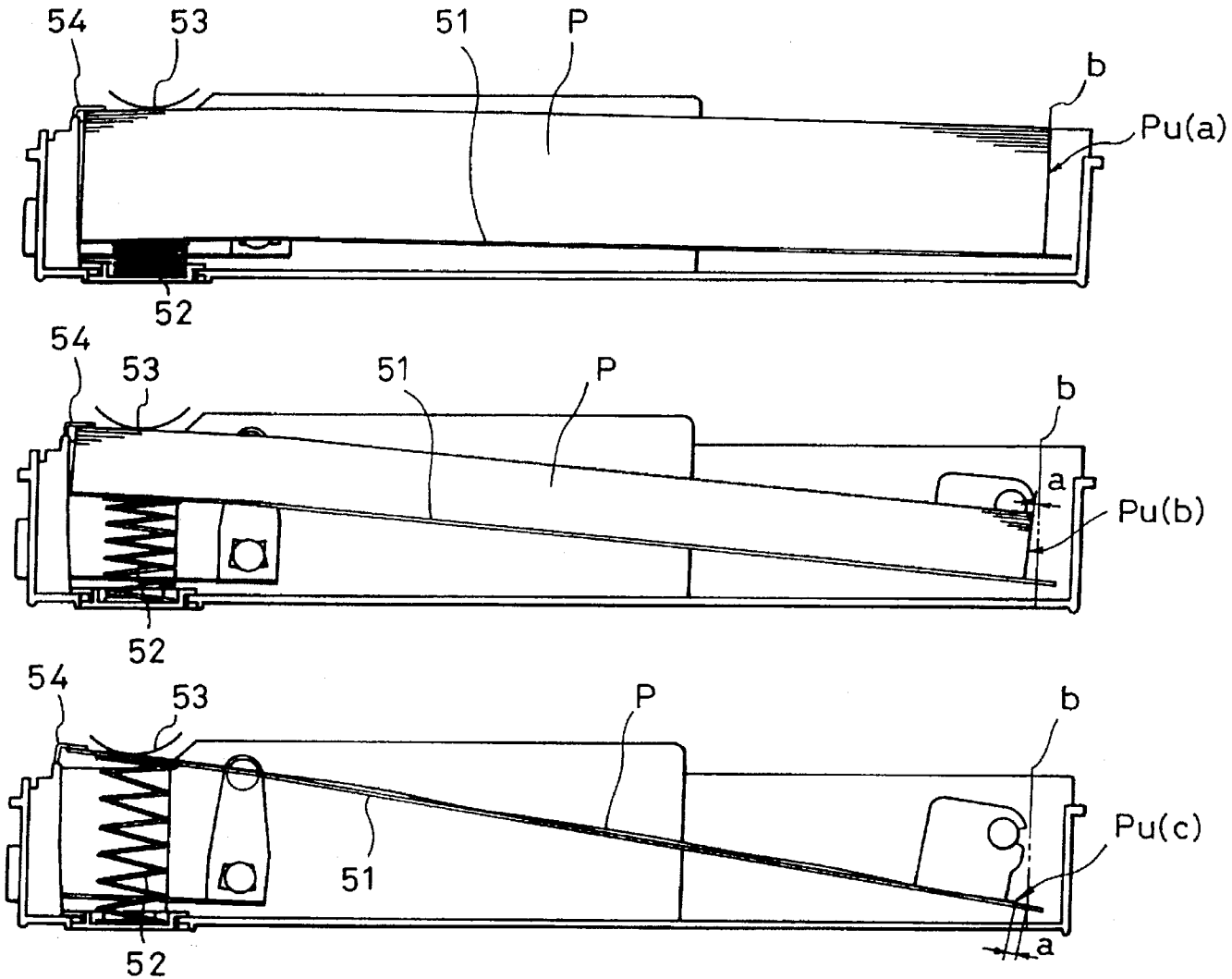
FIG. 13(a) PRIOR ART
FIG. 13(b) PRIOR ART
FIG. 13(c) PRIOR ART
FIGS. 13(*a*) to 13(*c*) are drawings illustrating changes in the trailing end position of sheets with change in the amount of the sheets loaded in a conventional feeding cassette.
Figure 14A:
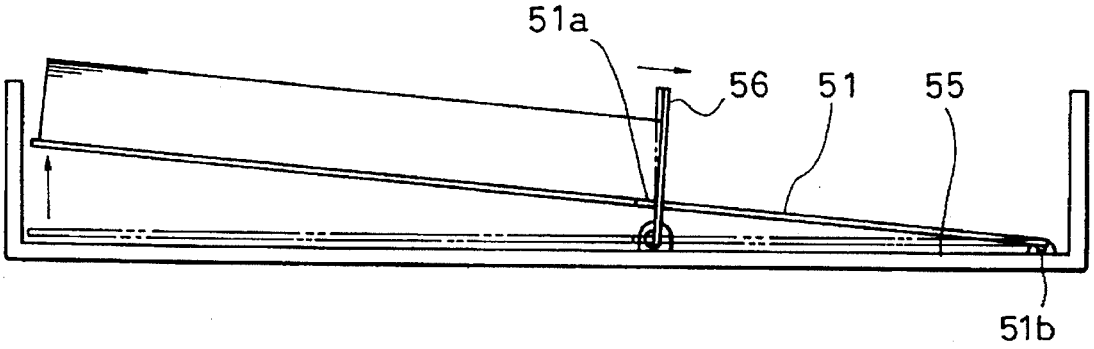
FIG. 14(a) PRIOR ART
FIGS. 14(*a*) and 14(*b*) are drawings illustrating the construction and problems of a conventional feeding cassette.
Figure 14B:
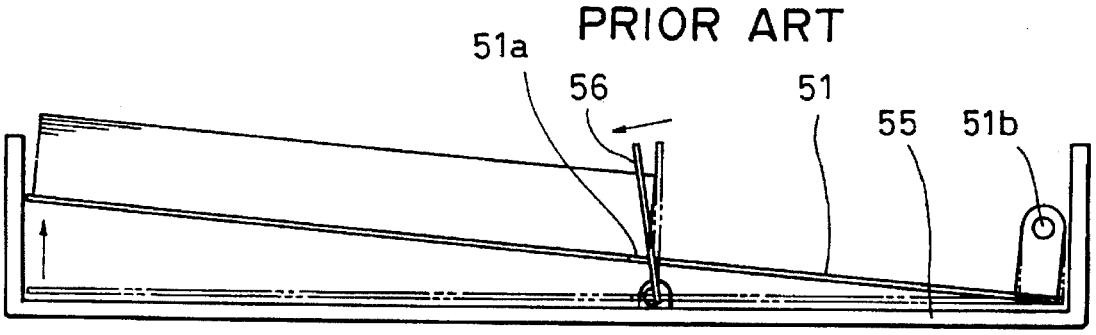
FIG. 14(b) PRIOR ART
Figure 15A:
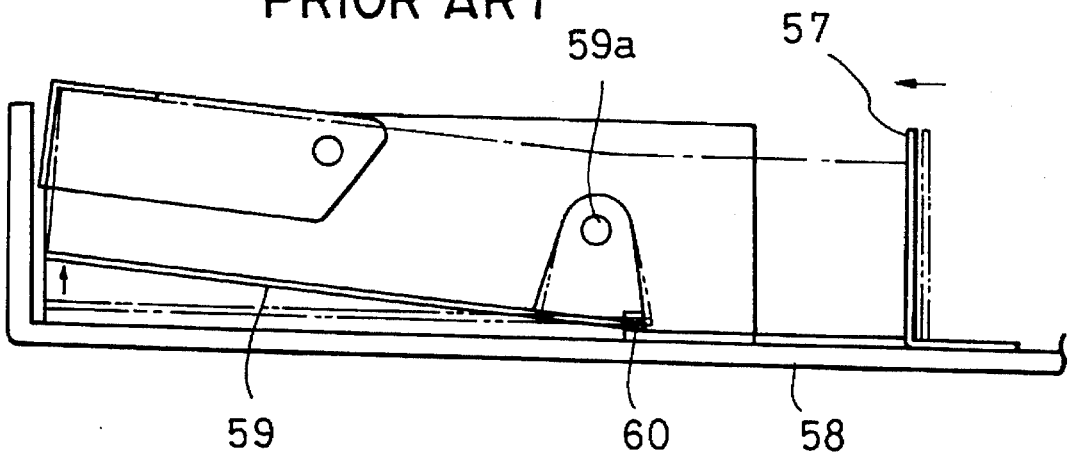
FIG. 15(a) PRIOR ART
FIGS. 15(*a*) and 15(*b*) are drawings illustrating the construction and problems of a conventional feeding cassette.
Figure 15B:
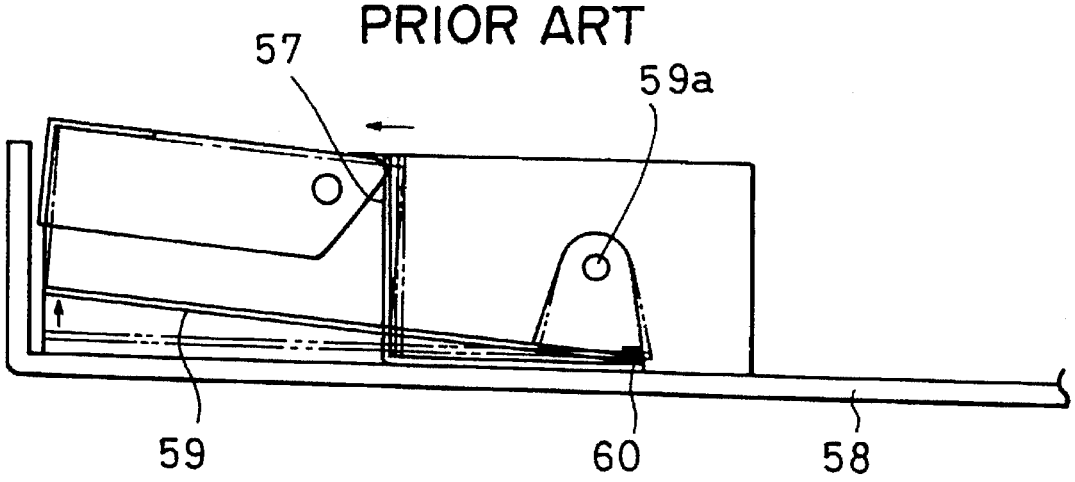
FIG. 15(b) PRIOR ART

The intermediate plate 25 is rotated clockwise around the axis 25*a* and moved upward by the urging force of the pressure spring 27 as the volume of recording sheets loaded in the feeding cassette 16 decreases. At this time, when the amount of engagement between the recording sheets P and the separation claws 31L and 31R is kept constant, as in the conventional example shown in FIG. 13, the recording sheets P slip down due to the gap a produced at the trailing ends of the recording sheets, thereby decreasing the amount of engagement between the recording sheets P and the separation claws 31L and 31R, and making the separation performance unstable.

In this embodiment, therefore, the trailing end regulating plate 33 is always guided to an orthogonal state with respect to the intermediate plate 25 by the trailing end regulating plate guide 34 fixed at the predetermined position of the intermediate plate 25. Therefore, it is possible to prevent the occurrence of a gap between the trailing ends of the recording sheets P and the trailing end regulating plate 33, and to maintain the amount of engagement between the separation claws 31L and 31R and the recording sheets P. Accordingly, the separation performance is stable. FIGS. 9(*a*) to (*c*) illustrate the operations of the intermediate plate 25, the trailing end regulating plate 33 and the trailing end regulating plate guide 34 when the recording sheets P are in the full loading, medium loading and small loading states, respectively, in the feeding cassette 16.

In FIGS. 9(*a*) to (*c*), the intermediate plate 25 is rotated in the clockwise direction around the axis 25*a* and moved upward by the urging force of the pressure spring as the volume of recording sheets P loaded on the intermediate plate 25 decreases, and at the same time, the trailing end regulating plate guide 34 is also moved upward with the intermediate plate 25 while maintaining the orthogonal state with respect to the intermediate plate 25. When the intermediate plate 25 rotates, the trailing end regulating plate 33 which is orthogonally provided on the bottom plate 22*e* pushes the trailing ends of the recording sheets P forward. However, since the guide piece 33*b* of the trailing end regulating plate 33 is loosely fitted into the slit 22*h*, and since the projections 33*a* are held by the trailing end regulating plate guide 34, the trailing end regulating plate 33 is finely adjusted to be orthogonal to the intermediate plate 25 together with the trailing end regulating plate guide 34.

As a result, no force is applied to push the trailing ends of the recording sheets by the trailing end regulating plate 33 even if the amount of recording sheets P loaded on the intermediate plate 25 changes, and the amount of engagement between the separation claws 31L and 31R and the recording sheets P can be kept constant, thereby maintaining the separation performance. Since the trailing end regulating plate can constantly be disposed orthogonal to the intermediate plate 25, regardless of the rotational position of the intermediate plate 25, it is possible to make the feeding cassette 16 universally suitable for different sheet sizes and amounts. Further, since the trailing end regulating plate 33 is mounted to the bottom plate 22*e*, unlike the case where the trailing end regulating plate 33 is fixed to the intermediate plate 25, the upper end of the regulating plate 33 does not project upward even if the intermediate plate 25 rotates. There is thus no need for a space above the mounting position, and thus an attempt can be made to decrease the size of the apparatus.

Figure 10:
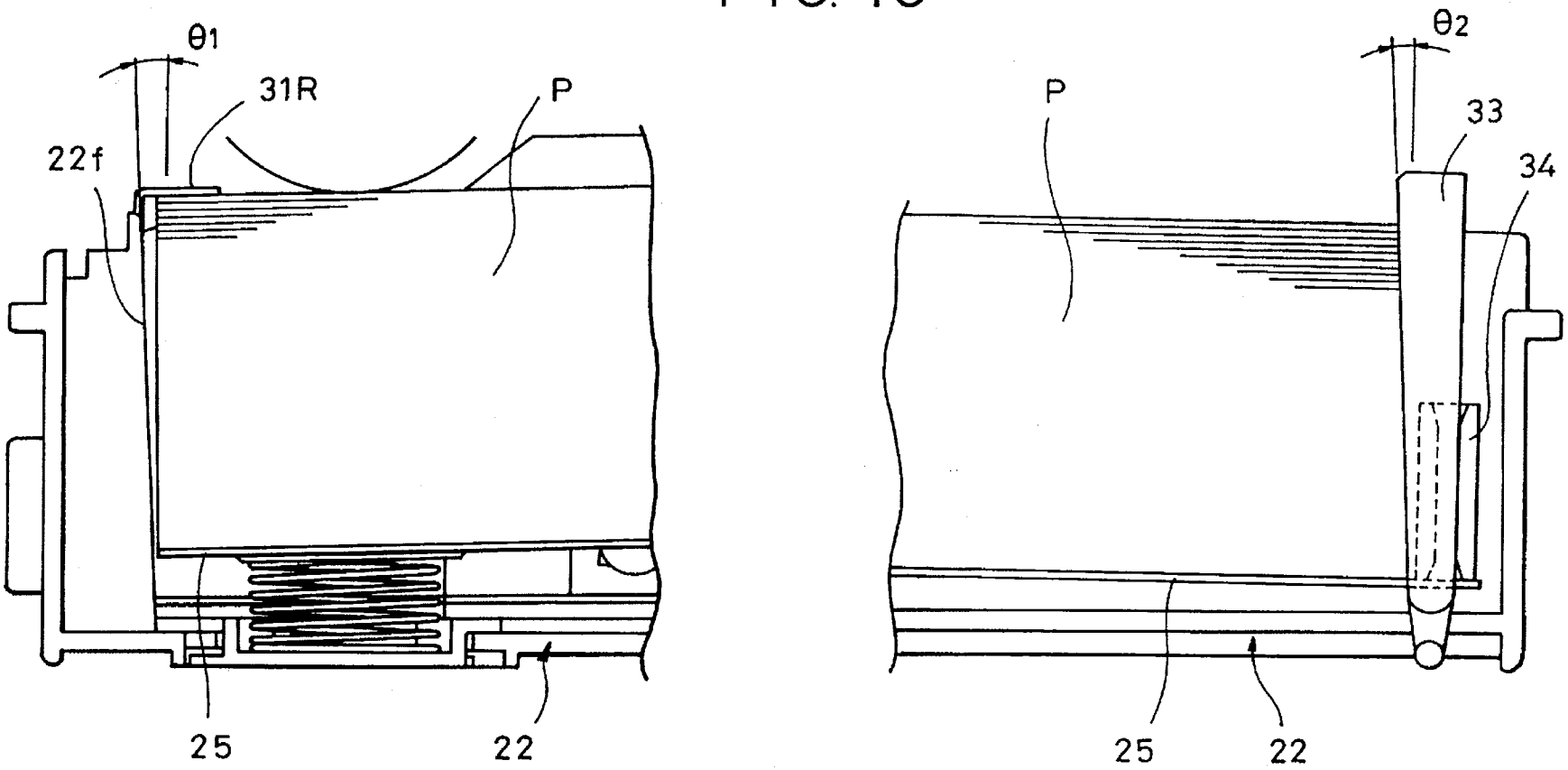
FIG. 10 is a sectional view illustrating an embodiment in which a regulating surface of a trailing end regulating plate is inclined.

As illustrated in FIG. 10, the sheet leading end butt wall 22*f* for regulating the leading end of a sheet is forwardly inclined at an angle of $\theta_1$° to prevent interference of the tip thereof with the rotation of the intermediate plate 25. Thus, the amount of engagement between the sheets and the separation claws 31L and 31R might be slightly changed in an amount corresponding to the inclination. Therefore, the surface of the trailing end regulating plate 33 for regulating the sheets is also forwardly inclined at an angle of $\theta_2$°, as shown in FIG. 10, so that the amount of engagement can more completely be kept constant. The angles $\theta_1$°and $\theta_2$° may be the same.

Since the feeding cassette 16 used in this embodiment is a universal cassette, and since the feeding pressure (contact pressure between the sheets and the feeding roller) must be made stable for permitting feeding of recording sheets P of different sizes, the pressure spring 27 can be exchanged. When the pressure spring 27 is exchanged by removing the side regulating plates 28*a* and 28*b*, and the intermediate plate 25, the efficiency of the work is decreased.

Figure 11:
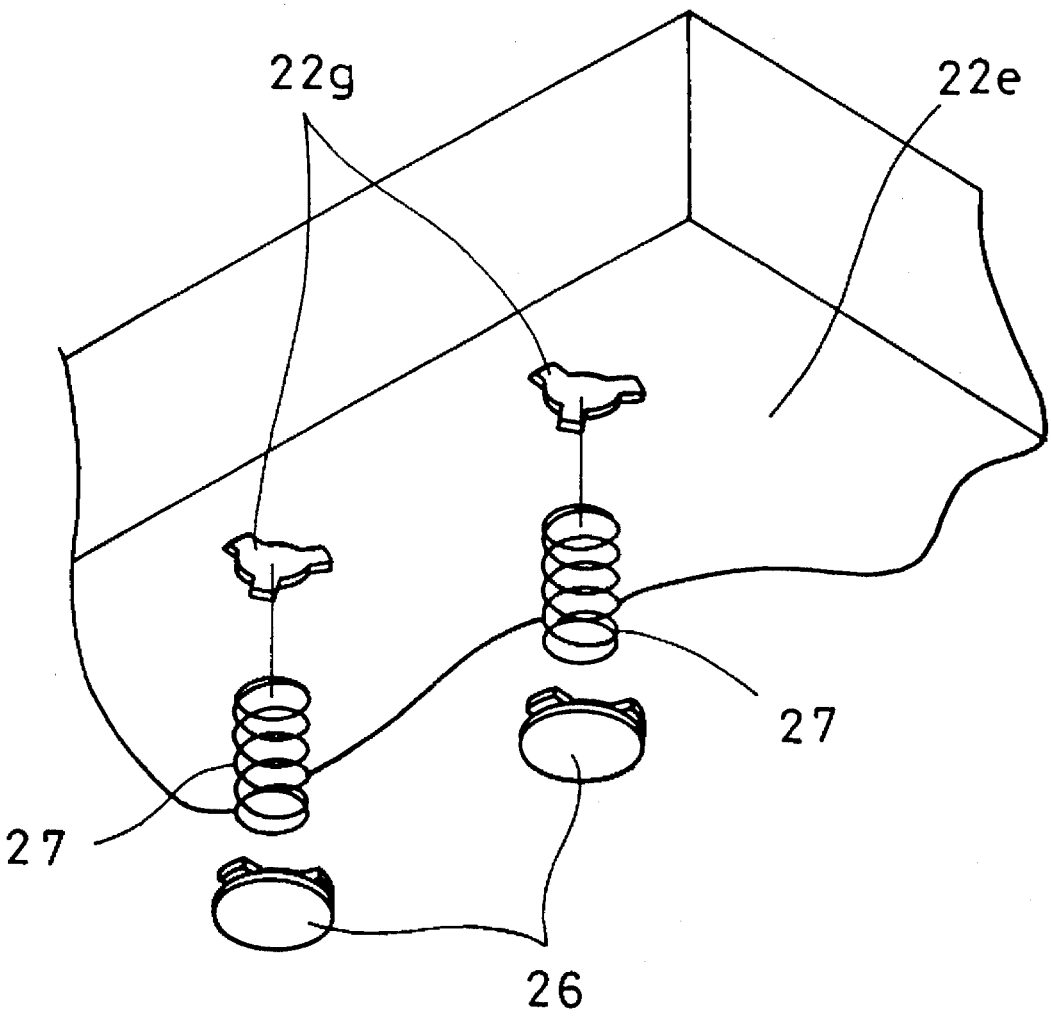
FIG. 11 is a drawing illustrating a method of exchanging pressure springs.
Figure 12:
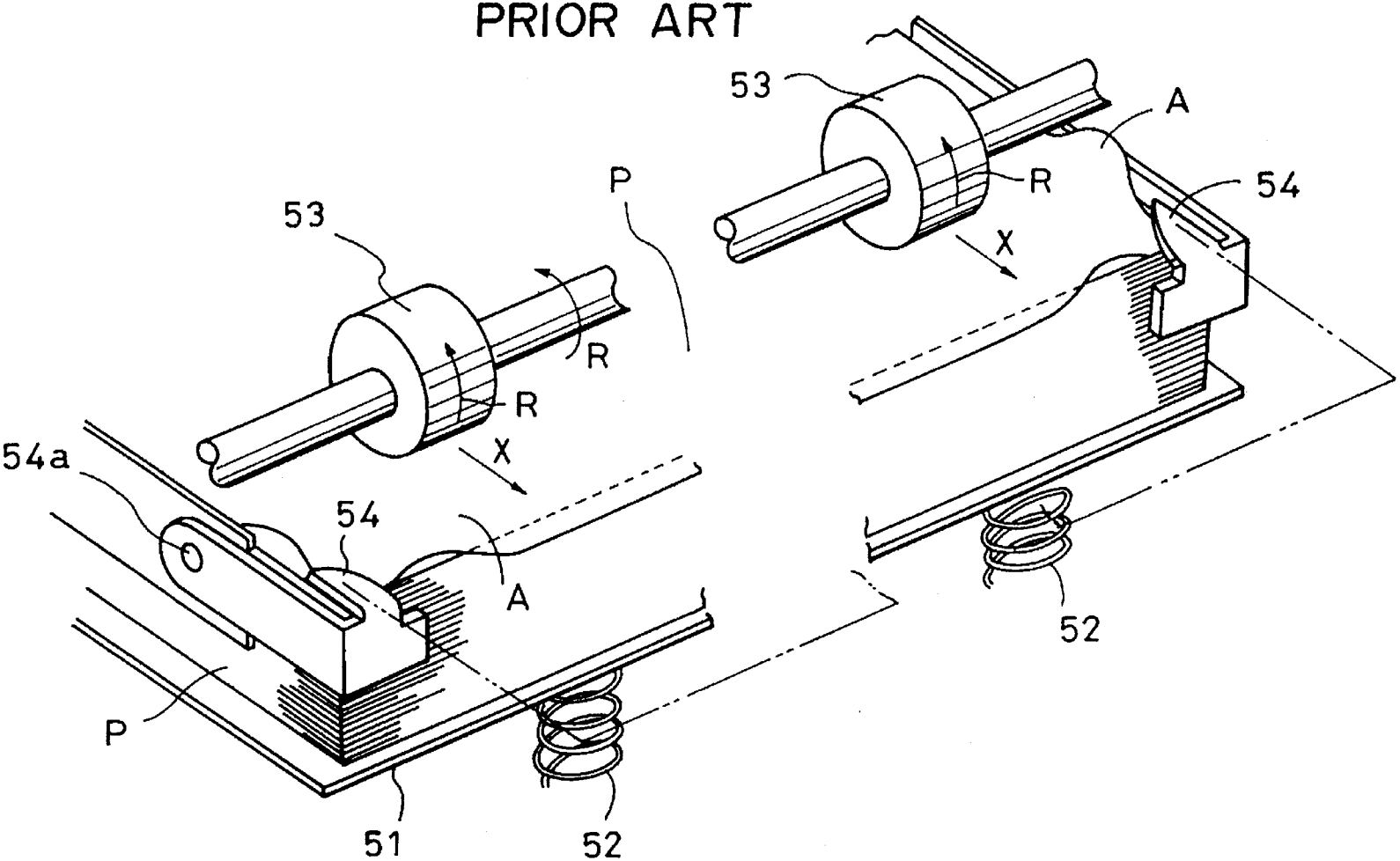
FIG. 12 PRIOR ART
FIG. 12 is a drawing illustrating a feeding cassette which employs a conventional claw separation method.

As illustrated in FIG. 11, therefore, the pressure spring 27 can be removed and exchanged by opening the cassette bottom cover 26 which is fitted into the hole 22*g* provided in the bottom plate 22*e* of the body case 22. This can remove difficulties in the work of exchanging the pressure spring 27, and facilitate making the feeding cassette 16 universally suitable for different sheet types. The used pressure spring 27 that is exchanged is for another stored in a storage compartment 23*a* (FIG. 3) provided in the handle 23 of the feeding cassette 16 so as to prevent the loss thereof.

An image forming apparatus to which the present invention is applied is not limited to a facsimile apparatus, and the present invention can be applied to other apparatuses such as a copying machine, a printer and so on.

The individual components shown in outline or designated by blocks in the drawings are all well-known in the image recording arts and their specific construction and operation are not critical to the operation or best mode for carrying out the invention.

While the present invention has been described with respect to what is presently considered to be the preferred embodiments, it is to be understood that the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet loading device mounted on a body of an apparatus and containing sheets to be fed by sheet feeding means, comprising:

sheet containing means for containing a plurality of sheets;

sheet supporting means, rotatably provided on said sheet containing means, for supporting sheets;

a separation claw for separating, one by one, the sheets supported by said sheet supporting means when the sheets are fed by the sheet feeding means;

trailing end regulating means for regulating the trailing end position of the sheets supported on said sheet supporting means; and guide means, selectively provided at one of a plurality of predetermined positions on said sheet supporting means, for maintaining said trailing end regulating means at a predetermined angle with respect to a supporting surface of said sheet supporting means while permitting said trailing end regulating means to move in a direction substantially at the predetermined angle with respect to the supporting surface.

2. A sheet loading device according to claim 1, wherein said trailing end regulating means is mounted so that it can swing and can slide in the direction of feeding of the sheets.

3. A sheet loading device according to claim 1, wherein said guide means is detachably mountable by fitting a fitting portion thereof into a hole formed in said sheet supporting means in accordance with the size of the sheets.

4. A sheet loading device according to claim 1 or 2, wherein a rib is provided on one of said guide means and said trailing end regulating means, and a groove in which said rib is slidably fitted is provided on the other so that said guide means maintains said trailing end regulating means in a state orthogonal to the supporting surface even if said sheet supporting means rotates.

5. A sheet loading device according to claim 1, wherein said trailing end regulating means is supported to be orthogonal to the supporting surface of said sheet supporting means.

6. A sheet loading device according to claim 5, wherein said sheet containing means has a leading end regulating surface for regulating the leading end of the sheets, obliquely provided on said sheet supporting means, and a trailing end regulating surface of said trailing end regulating means is in contact with the sheets and is inclined in the same direction as the leading end regulating surface.

7. A sheet loading device mounted on a body of an apparatus and containing sheets to be fed by sheet feeding means, comprising:

sheet containing means for containing a plurality of sheets;

sheet supporting means, rotatably provided on said sheet containing means, for supporting sheets;

a separation claw for separating, one by one, the sheets supported by said sheet supporting means when the sheets are fed by the sheet feeding means;

trailing end regulating means, swingably and slidably mountable to a bottom of said sheet containing means, for regulating the trailing end position of the sheets supported on said sheet supporting means; and guide means provided on said sheet supporting means for maintaining said trailing end regulating means at a predetermined angle with respect to a supporting surface of said sheet supporting means while permitting said trailing end regulating means to move in a direction substantially at the predetermined angle with respect to the supporting surface.

8. A sheet loading device according to claim 7, wherein a slide groove is formed in the bottom of said sheet containing means, and said trailing end regulating means slidably engages said slide groove so as to be movable in the direction of feeding of the sheets.

9. A sheet loading device according to claim 7, wherein an opening is formed in said sheet supporting means and said trailing end regulating means extends through the opening and projects above the supporting surface.

10. A sheet loading device according to claim 7, wherein a rib is provided on one of said guide means and said trailing end regulating means and a groove into which said rib is slidably fitted is provided on the other so that said guide means maintains said trailing end regulating means in a state orthogonal to the supporting surface even if said sheet supporting means rotates.

11. A sheet loading device according to claim 7, wherein said trailing end regulating means is supported to be orthogonal to the supporting surface of said sheet supporting means.

12. A sheet loading device according to claim 7, wherein said sheet containing means has a leading end regulating surface, for regulating the leading ends of the sheets, obliquely provided on said sheet supporting means, and a trailing end regulating surface of said trailing end regulating means is in contact with the sheets and is inclined in the same direction as the leading end regulating surface.

13. An image forming apparatus comprising:

a sheet loading device mounted on said apparatus and containing sheets to be fed; said sheet loading device including:

sheet containing means for containing a plurality of sheets;

sheet supporting means, rotatably provided on said sheet containing means, for supporting sheets;

a separation claw for separating, one by one, the sheets supported by said sheet supporting means when the sheets are fed;

trailing end regulating means for regulating the trailing end position of the sheets supported on said sheet supporting means; and guide means, selectively provided at one of a plurality of predetermined positions on said sheet supporting means, for maintaining said trailing end regulating means at a predetermined angle with respect to a supporting surface of said sheet supporting means while permitting said trailing end regulating means to move in a direction substantially at the predetermined angle with respect to the supporting surface;

sheet feeding means for feeding the sheets contained in said sheet loading device; and image forming means for forming an image on a sheet fed by said sheet feeding means.

14. An apparatus according to claim 13, wherein said trailing end regulating means is mounted so that it can swing and can slide in the direction of feeding of the sheets.

15. An apparatus according to claim 13, wherein said guide means is detachably mountable by fitting a fitting portion thereof into a hole formed in said sheet supporting means in accordance with the size of the sheets.

16. An apparatus according to claim 13 or 14, wherein a rib is provided on one of said guide means and said trailing end regulating means, and a groove in which said rib is slidably fitted is provided on the other so that said guide means maintains said trailing end regulating means in a state orthogonal to the supporting surface even if said sheet supporting means rotates.

17. An apparatus according to claim 13, wherein said trailing end regulating means is supported to be orthogonal to the supporting surface of said sheet supporting means.

18. An apparatus according to claim 17, wherein said sheet containing means has a leading end regulating surface, for regulating the leading end of the sheets, obliquely provided on said sheet supporting means, and a trailing end regulating surface of said trailing end regulating means is in contact with the sheets and is inclined in the same direction as the leading end regulating surface.

19. An image forming apparatus comprising:

a sheet loading device mounted on said apparatus and containing sheets to be fed, said sheet loading device comprising:

sheet containing means for containing a plurality of sheets;

sheet supporting means, rotatably provided on said sheet containing means, for supporting sheets;

a separation claw for separating, one by one, the sheets supported by said sheet supporting means when the sheets are fed;

trailing end regulating means, swingably and slidably mountable to a bottom of said sheet containing means, for regulating the trailing end position of the sheets supported on said sheet supporting means; and guide means provided on said sheet supporting means for maintaining said trailing end regulating means at a predetermined angle with respect to a supporting surface of said sheet supporting means while permitting said trailing end regulating means to move in a direction substantially at the predetermined angle with respect to the supporting surface;

sheet feeding means for feeding the sheets contained in said sheet loading device; and image forming means for forming an image on a sheet fed by said sheet feeding means.

20. An apparatus according to claim 19, wherein a slide groove is formed in the bottom of said sheet containing means, and said trailing end regulating means slidably engages said slide groove so as to be movable in the direction of feed of the sheets.

21. An apparatus according to claim 19, wherein an opening is formed in said sheet supporting means and said trailing end regulating means extends through the opening and projects above the supporting surface.

22. An apparatus according to claim 19, wherein a rib is provided on one of said guide means and said trailing end regulating means, and a groove into which said rib is slidably fitted is provided on the other so that said guide means maintains said trailing end regulating means in a state orthogonal to the supporting surface even if said sheet supporting means rotates.

23. An apparatus according to claim 19, wherein said trailing end regulating means is supported to be orthogonal to the supporting surface of said sheet supporting means.

24. An apparatus according to claim 19, wherein said sheet containing means has a leading end regulating surface, for regulating the leading ends of the sheets, obliquely provided on said sheet supporting means, and a trailing end regulating surface of said trailing end regulating means is in contact with the sheets and is inclined in the same direction as the leading end regulating surface.

* * * * *

UNITED STATES PATENT AND TRADEMARK OFFICE

CERTIFICATE OF CORRECTION

PATENT NO. : 5,632,477
DATED : May 27, 1997
INVENTOR(S) : Kazuyuki MORINAGA

It is certified that error appears in the above-identified patent and that said Letters Patent is hereby corrected as shown below:

COLUMN 1, line 65, delete "p" and insert therefor --P--.

COLUMN 8, line 1, delete "a".

COLUMN 13, line 21, after "fed", delete the semicolon (";") and insert therefor a comma (",").

Signed and Sealed this

Twenty-fifth Day of November, 1997

*Attest:*

*Attesting Officer*

BRUCE LEHMAN

*Commissioner of Patents and Trademarks*